US005861708A

United States Patent [19]

Van Eck

[11] Patent Number: 5,861,708

[45] Date of Patent: Jan. 19, 1999

[54] COLOR CATHODE RAY TUBE

[75] Inventor: Arnoldus H. M. Van Eck, Eindhoven, Netherlands

[73] Assignee: U.S. Philips Corporation, New York, N.Y.

[21] Appl. No.: 768,352

[22] Filed: Dec. 17, 1996

[30] Foreign Application Priority Data

Dec. 22, 1995 [EP] European Pat. Off. ..... 95203624

[51] Int. Cl.[6] ..... H01J 29/50

[52] U.S. Cl. ..... 313/414; 313/460; 445/36

[58] Field of Search ..... 313/414, 416, 313/432, 436, 460, 458; 445/34, 36, 49

[56] References Cited

U.S. PATENT DOCUMENTS 3,991,338 11/1976 van den Einden et al. ..... 313/417
4,877,993 10/1989 Ogasa ..... 313/414
4,937,491 6/1990 Kauwenberg ..... 445/47
4,990,823 2/1991 Swaving et al. ..... 445/36
5,081,393 1/1992 Kinami ..... 313/412
5,096,449 3/1992 Matsuzaki ..... 445/36
5,140,218 8/1992 Van Eck ..... 313/414
5,235,241 8/1993 Van Eck et al. ..... 313/414
5,574,330 11/1996 Matsuda et al. ..... 313/460

*Primary Examiner*—Sandra O'Shea
*Assistant Examiner*—Michael Day
*Attorney, Agent, or Firm*—Robert J. Kraus

[57] ABSTRACT

A color cathode ray tube includes an in-line electron gun. The electron gun includes at least a tubular part which is composed of two (or more) folded portions which are secured to each other.

15 Claims, 4 Drawing Sheets

COLOR CATHODE RAY TUBE

BACKGROUND OF THE INVENTION

This invention relates to a color cathode ray tube comprising an in-line electron gun having at least one electrode which includes a substantially flat grid with apertures for allowing passage of electron beams, and a tubular part which is connected to said flat grid.

Such color cathode ray tubes are known and are used, inter alia, in display devices such as color television receivers and color monitors for computers.

When such color cathode ray tubes are in operation, three electron beams are generated by an in-line electron gun. Said electron beams are accelerated and focused by means of electrodes. Some of the electrodes, particularly those which are at a relatively high voltage, are provided with more or less tubular parts which extend substantially parallel to the electron beams. One of the functions of these tubular parts is to shield the electron beams from external electric and/or magnetic fields. For the known color cathode ray tubes, these parts are made by means of a deep drawing process, in which said part and the flat grid are made in a single piece, or said part consists of a piece of deep-drawn tube to which the flat grid has been welded.

However, ever higher demands are imposed on the accuracy with which the various parts of an electron gun are manufactured. Moreover, in the case of color cathode ray tubes, the high-voltage sensitivity is a constantly recurring problem.

SUMMARY OF THE INVENTION

It is an object of the invention to provide a color cathode ray tube of the type mentioned in the opening paragraph, in which one or both of the above-mentioned problems are alleviated.

To this end, the color cathode ray tube in accordance with the invention is characterized in that the tubular part is composed of a number, preferably two, folded portions which extend parallel to the electron beams and which are interconnected.

Such folded portions can be made of plates without subjecting the material of the plates to a deep drawing operation. Deep drawing is a process in which a lubricant must necessarily be used. Even after a thorough cleaning operation, the lubricant leaves some residue, which may have a negative effect on the high-voltage behavior of the cathode ray tube. A cleaner electrode, i.e. an electrode having a better high-voltage resistance, can be obtained by using parts which are folded and subsequently interconnected.

In addition, deep drawing is a process which yields a product which is inaccurate to some extent. This can be attributed to the fact that the deep-drawn part always springs back after the deep drawing operation. This phenomenon does not occur if folded plates are used. Consequently, the tubular part has a greater flatness and dimensional accuracy than deep-drawn parts.

The folded portions are preferably similar in form. As a result, the electron gun is simplified, which leads to lower costs.

Preferably, each of the folded portions comprises a projection, which projections are interconnected, and the tubular part formed by the plate-shaped portions is connected to supports of the electron gun via said projections.

The in-line electron gun comprises supports, generally made of glass, to which the various electrodes are secured.

These and other aspects of the invention will be apparent from and elucidated with reference to the embodiments described hereinafter.

DESCRIPTION OF THE PREFERRED EMBODIMENT

Figure 1:
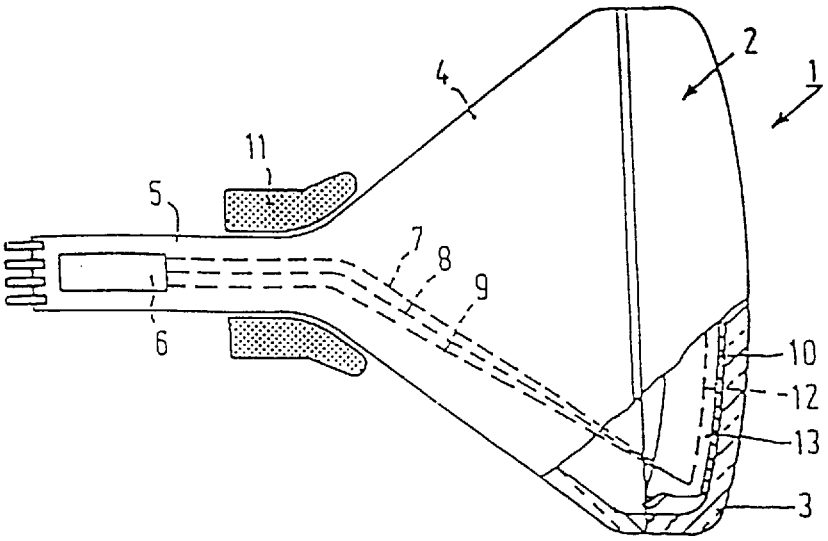
FIG. 1 PRIOR ART
FIG. 1 is a cathode ray tube.

The Figures are not drawn to scale. In general, like reference numerals refer to like parts.

Color cathode ray tube 1 (FIG. 1) comprises an evacuated envelope 2 having a display window 3, a cone portion 4 and a neck 5. In the neck 5 there is provided an electron gun 6 for generating three electron beams 7, 8 and 9. A display screen 10 is situated on the inside of the display window 3. The display screen 10 comprises a pattern of phosphor elements luminescing in red, green and blue. On their way to the display screen, the electron beams 7, 8 and 9 are deflected across the display screen 10 by means of a deflection unit 11 and pass through a shadow mask 12 which is arranged in front of the display window 3 and which comprises a thin plate with apertures 13. The three electron beams 7, 8 and 9 pass through the apertures 13 of the shadow mask at a small angle with respect to each other and, consequently, each electron beam impinges on phosphor elements of only one color.

Figure 2:
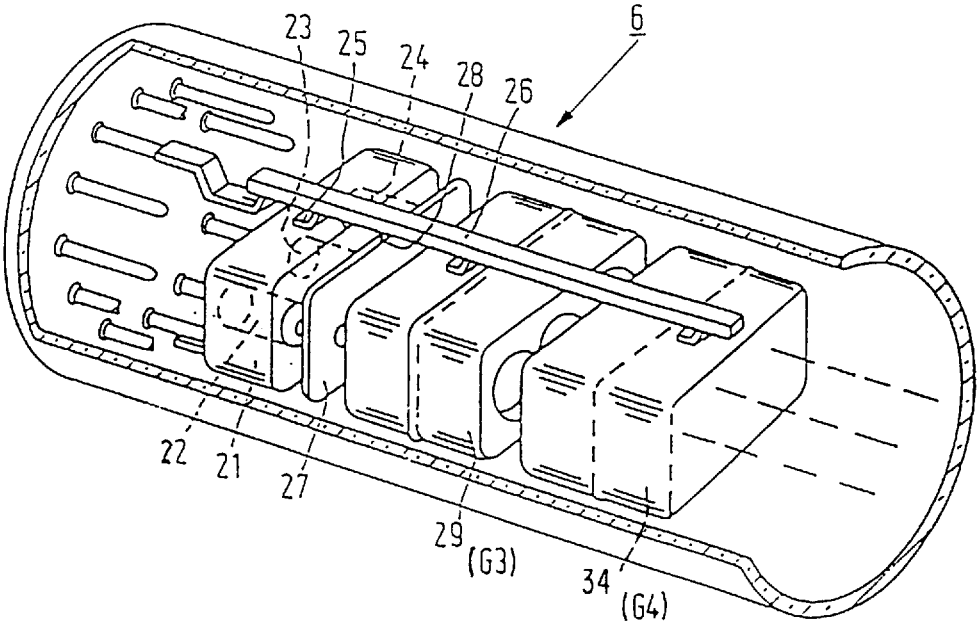
FIG. 2 PRIOR ART
FIG. 2 is an electron gun.

FIG. 2 is a partly perspective view of an electron gun 6. The electron gun comprises a common control electrode 21, also referred to as the $G_1$ electrode, in which three cathodes 22, 23 and 24 are secured. The $G_1$ electrode is secured to supports 26 by means of connecting elements 25. These supports are made of glass and are also referred to as "beading rods". In this example, the electron gun 6 further includes a common plate-shaped electrode 27, also referred to as the $G_2$ electrode, and the common electrodes 29 and 31 which are also secured to the supports by means of connecting elements. In this Figure, the electrodes 29 and 31 are manufactured from deep-drawn parts.

Figure 3A:
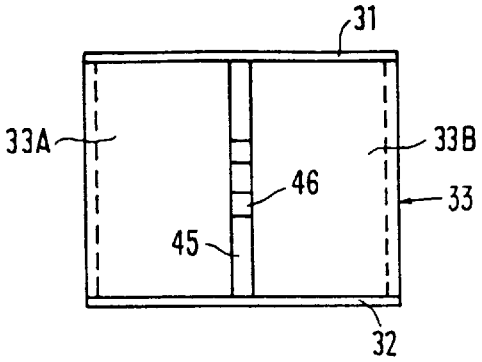
FIGS. 3A to 3C show a part of an electron gun in a cathode ray tube in accordance with the invention.
Figure 3B:
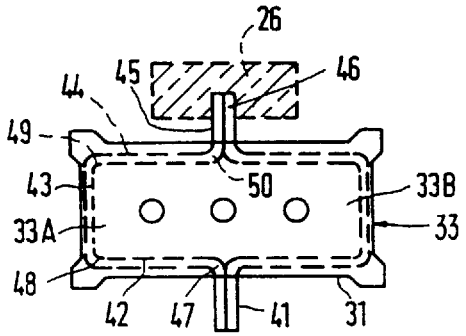
Figure 3C:
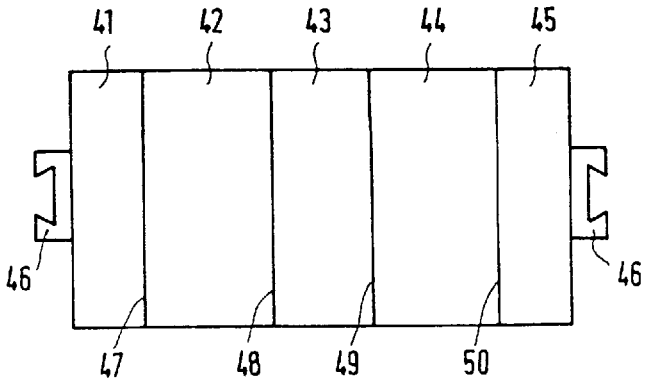

An electrode of an electron gun for a cathode ray tube in accordance with the invention is shown in a side view, plan view and in the unfolded state in FIGS. 3A, 3B and 3C, respectively.

The electrode comprises two plate-shaped grids 31 and 32 between which a tubular part 33 is situated. This tubular part includes two portions 33A and 33B. One of these portions is shown in the unfolded state in FIG. 3C. This portion comprises the flat members 41, 42, 43, 44 and 45, of which the members 41 and 45 are provided with projections 46. Further, the folding lines 47, 48, 49 and 50 are shown. Such a portion can be manufactured very accurately without subjecting the material to a deep drawing process, for example, by means of punching.

Preferably, the folding lines are made, for example, by punching or notching, in the flat part. Both portions 33A and 33B are subsequently folded and welded together by means of the members 45. The plate-shaped grids are secured thereto, for example, by means of welding. The upper edge of the portions 33A and 33B can be made very accurately, so that the position of the electrode 33 can be determined more accurately than in the case of a deep-drawn electrode.

Figure 4A:
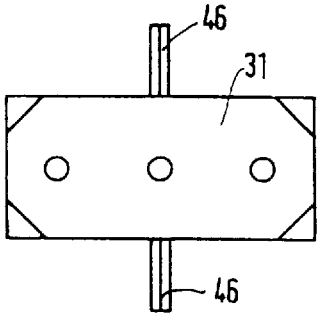
FIGS. 4A, 4B, 5A, 5B and 6 show further examples of a part of an electron gun for a cathode ray tube in accordance with the invention.
Figure 4B:
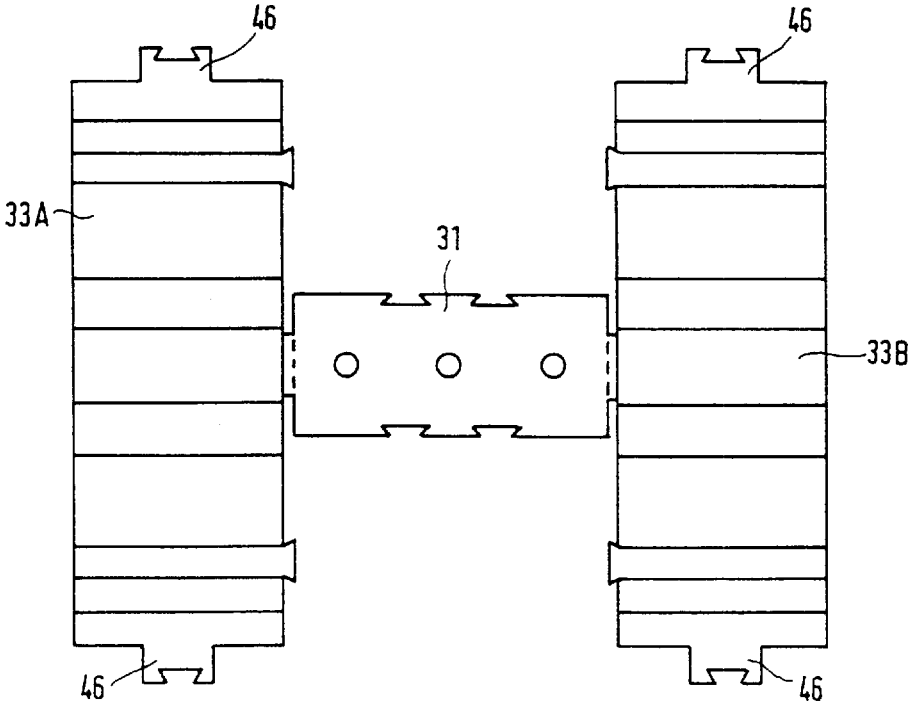

An example of a preferred embodiment of an electrode for an electron gun in accordance with the invention is shown in a plan view and in the unfolded state in FIGS. 4A and 4B, respectively. In this example, the grid 31 and the portions 33A and 33B are manufactured from a single piece of folded material 51. This is a preferred embodiment because the number of separate parts necessary for the manufacture of an electron gun is reduced by one. Thus, within the scope of the invention, the folded portions may be interconnected.

Figure 5A:
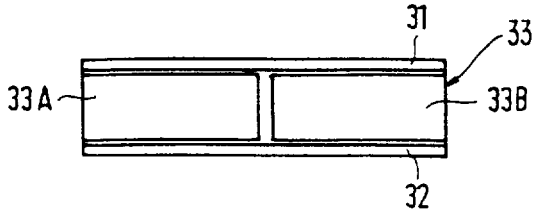
Figure 5B:
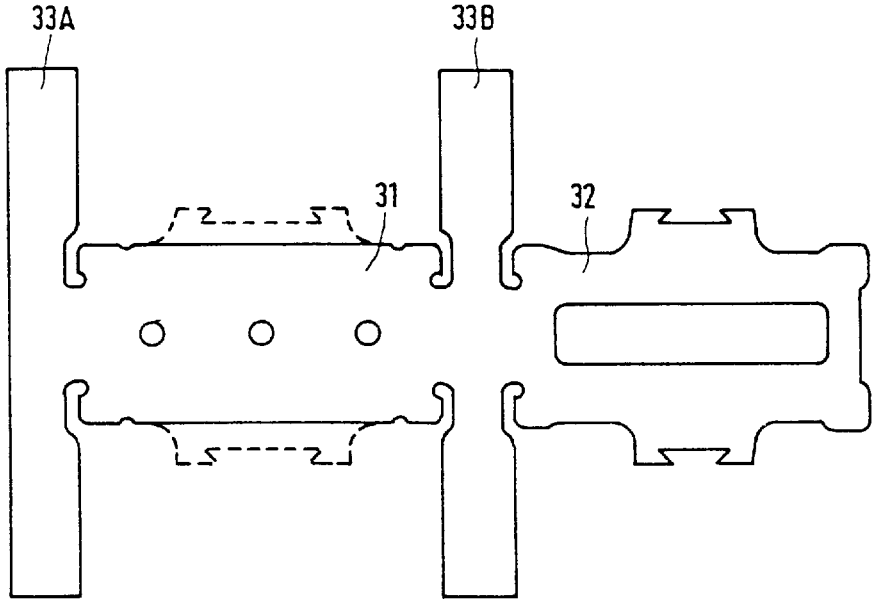

A further example of a preferred embodiment of an electrode for an electron gun in accordance with the invention is shown in a side view and in the unfolded state in FIGS. 5A and 5B, respectively. In this example, the grids 31 and 32 and the portions 33A and 33B are manufactured from a single piece of folded material 52. This is another preferred embodiment because the number of separate parts necessary for the manufacture of an electron gun has been reduced further.

All embodiments (FIGS. 3A to 3C, 4A, 4B, 5A, 5B) also have the advantage that an electrode comprising a tubular part can be made in the form of a strip.

For example, the electrode shown in FIG. 4B can form part of a strip in which many of such electrodes are made, for example, by punching or laser cutting. Such a strip can be wound op a reel and, in the manufacturing process, supplied to a machine which removes the electrode from the strip, folds the electrode and secures it by welding. This has the advantage that, prior to their manufacture, the electrodes occupy very little space. The advantage of folding over bending or drawing is that a lubricant can be dispensed with and less plastic or elastic deformation occurs.

It will be obvious that within the scope of the invention many variations are possible.

Figure 6:
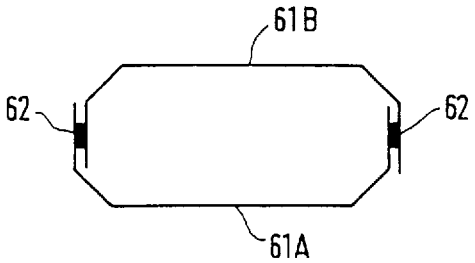

For example, FIG. 6 is a plan view of a very simple embodiment of the invention, in which a tubular part is made from two portions 61A and 61B which are welded together at points 62.

The invention is particularly advantageous if the folded portions are made from a material which cannot be deep-drawn, or only with difficulty, such as some NiFe compounds. Such compounds have a very low coefficient of thermal expansion, which is very favorable. These materials can be folded, but they cannot be deep-drawn or bent, or only with great difficulty. In summary, the invention relates to a color cathode ray tube comprising an in-line electron gun. The electron gun includes at least a tubular part which is composed of two (or more) folded portions which are secured to each other. The folded portions are preferably folded along folding lines, that is lines along which the material has been weakened, for example by notching.

I claim:

1. A color cathode ray tube comprising: an in-line electron gun having means for generating three coplanar electron beams and at least one electrode which includes a substantially flat grid with apertures for allowing passage of the electron beams, and a tubular part which is connected to said flat grid, characterized in that the tubular part is composed of at least two separate folded portions which extend parallel to the electron beams, and means for securing the two folded portions to one another so that they are interconnected.

2. A color cathode ray tube as claimed in claim 1, characterized in that the two folded portions are similar in form.

3. A color cathode ray tube as claimed in claim 1, characterized in that the flat grid and the at least two folded portions comprise respective portions of a single piece of folded material.

4. A color cathode ray tube as claimed in claim 3, further comprising a second flat grid wherein the two flat grids and the folded portions comprise respective portions of a single piece of folded material.

5. A color cathode ray tube as claimed in claim 1, characterized in that the folded portions are made of a material having a low coefficient of thermal expansion.

6. An in-line electron gun for use in a color cathode ray tube comprising:

cathode means for generating three coplanar electron beams and at least one electrode which includes a substantially flat grid with apertures for allowing passage of the electron beams, a tubular part connected to said flat grid and composed of at least two folded members which extend parallel to the electron beams, and means for securing the two folded members to one another so that they are interconnected.

7. An in-line electron gun as claimed in claim 6 wherein said two folded members comprising said tubular part have identical shapes.

8. An in-line electron gun as claimed in claim 6 wherein the flat grid and the at least two folded members comprise respective portions of a single piece of flat material including two elongated parallel portions with parallel fold lines therein and interconnected by an elongate apertured flat grid portion extending perpendicular to the two parallel portions, said single piece of flat material being folded along the fold lines so as to form said tubular part with attached apertured flat grid.

9. An-line electron gun as claimed in claim 8 wherein each of the folded members, in its unfolded state prior to folding, comprises a flat planar elongate element with fold lines therein formed without subjecting said folded members to a deep drawing operation so that the surfaces thereof are clean relative to electrodes formed by a deep drawing operation.

10. An in-line electron gun as claimed in claim 6 wherein each of said folded members is made of NiFe compound material having parallel fold lines therein weakened by notching or any equivalent procedure.

11. A color cathode ray tube comprising:

an evacuated envelope having a display window, an in-line electron gun mounted within said evacuated envelope for generating three electron beams, a display screen on the inside of the display window and comprising a pattern of luminescing phosphor elements, a deflection unit mounted on the outside of the evacuated envelope between the electron gun and the display screen, a thin plate with apertures positioned within said evacuated envelope in the vicinity of the display screen and closer to the electron gun, wherein the electron gun comprises;

at least one electrode which includes a substantially flat grid with apertures for allowing passage of the electron beams, a tubular part connected to said flat grid and composed of at least first and second folded members which extend parallel to the electron beams, and means for securing the first and second folded members together so that they form said tubular part.

12. The color cathode ray tube as claimed in claim 11 wherein at least the first folded member, in its unfolded state prior to folding, comprises a flat planar elongate element with fold lines therein perpendicular to a longitudinal axis of the first planar elongate element.

13. The color cathode ray tube as claimed in claim 11 wherein the flat apertured grid and the first and second folded members comprise a single element, each of said first and second folded members, in its unfolded state prior to folding, comprises a flat planar elongate element with fold lines therein and interconnected by an elongate apertured flat grid portion extending perpendicular to the two parallel portions, said single piece of flat material being folded along the fold lines so as to form said tubular part with attached apertured flat grid.

14. The color cathode ray tube as claimed in claim 11 wherein said first and second folded members each comprise first and second planar projections which are aligned when said members are folded to form said tubular part, and said means for securing comprises a weld connecting the first and second planar projections of the first folded member to corresponding respective first and second projections of the second folded member.

15. The color cathode ray tube as claimed in claim 14 wherein at least one pair of said projections is secured to a glass support member located within said evacuated envelope.

* * * * *